US010563674B2

(12) United States Patent
Richer

(10) Patent No.: US 10,563,674 B2
(45) Date of Patent: Feb. 18, 2020

(54) MULTI-HYDRAULIC CONTROL CIRCUIT

(71) Applicant: Robert Bosch GmbH, Stuttgart (DE)

(72) Inventor: Emmanuel Richer, Bourgoin Jallieu (FR)

(73) Assignee: Robert Bosch GmbH, Stuttgart (DE)

( * ) Notice: Subject to any disclaimer, the term of this patent is extended or adjusted under 35 U.S.C. 154(b) by 144 days.

(21) Appl. No.: 15/728,136

(22) Filed: Oct. 9, 2017

(65) Prior Publication Data

US 2018/0100521 A1 Apr. 12, 2018

(30) Foreign Application Priority Data

Oct. 10, 2016 (FR) ..... 16 59756

(51) Int. Cl.
*F15B 13/02* (2006.01)
*F15B 11/16* (2006.01)
*F15B 13/06* (2006.01)

(52) U.S. Cl.
CPC ..... *F15B 11/161* (2013.01); *F15B 13/026* (2013.01); *F15B 13/06* (2013.01); *F15B 2211/2053* (2013.01); *F15B 2211/71* (2013.01)

(58) Field of Classification Search
CPC ..... F15B 11/05; F15B 13/026; F15B 2211/30555
See application file for complete search history.

(56) References Cited

U.S. PATENT DOCUMENTS 5,305,789 A * 4/1994 Rivolier ..... F15B 13/0417 137/596
5,315,826 A * 5/1994 Hirata ..... E02F 9/2232 60/422
6,782,697 B2 * 8/2004 Mather ..... F15B 11/165 60/422
2017/0314577 A1 * 11/2017 Mizukami ..... F15B 11/161

FOREIGN PATENT DOCUMENTS

EP 0 566 449 A1 10/1993

* cited by examiner

*Primary Examiner* — F Daniel Lopez
(74) *Attorney, Agent, or Firm* — Maginot, Moore & Beck LLP

(57) ABSTRACT

A multi-control hydraulic circuit supplies receivers with hydraulic fluid delivered by a pump with an output controlled by the pressure of a control line depending on a load pressure of the receivers, and delivers the hydraulic fluid at a regulated pressure. The hydraulic circuit consists of hydraulic modules each associated with a receiver having a distributor which regulates the variable output supplying the receiver via a pressure compensator connected at its inlet to the outlet of the variable choke of the distributor, and at its outlet. The plunger manages the connection between its inlet and its outlet. The pressure compensator has a fluid link equipped with a choke and connects the outlet to the control line, irrespective of the position of the plunger.

6 Claims, 5 Drawing Sheets

MULTI-HYDRAULIC CONTROL CIRCUIT

This application claims priority under 35 U.S.C. § 119 to patent application no. FR 1,659,756, filed on Oct. 10, 2016 in France, the disclosure of which is incorporated herein by reference in its entirety.

BACKGROUND

A multi-control hydraulic circuit supplies receivers with hydraulic fluid delivered by a pump with an output controlled by the pressure of the control line depending on the load pressure of the receivers and delivers the hydraulic fluid at the regulated pressure. The circuit consists of hydraulic modules each associated with a receiver having a hydraulic distributor. Such a multi-control hydraulic circuit is known, in particular, in the document EP 0 566 449 B1, which describes a hydraulic distributor combining pressure compensation and the selection of maximum pressure.

It would be desirable to improve the operation of the hydraulic distributor, in particular for the transitional phases, to make the hydraulic circuit controlled in this way more flexible and effective.

SUMMARY

The subject of the disclosure relates to a multi-control hydraulic circuit for supplying receivers with hydraulic fluid delivered by a pump with an output controlled by the pressure of the control line depending on the load pressure of the receivers and delivering the hydraulic fluid at the regulated pressure. The circuit consists of hydraulic modules each associated with a receiver having a distributor, the slide valve of which, activated by the operator, regulates the variable output supplying the receiver via a pressure compensator connected at its inlet to the outlet of the variable choke of the distributor, and at its outlet to the supply of the associated receiver, by means of a non-return valve, the pressure compensator having a plunger which manages the connection between its inlet and its outlet, and one face of which is exposed to the control pressure of the control line, and the other face of which transmits this pressure to the outlet of the distributor in order to subject it to a fixed pressure difference corresponding to the difference between the control pressure and the pump pressure the plunger having a lateral passage connecting its inlet line and its outlet according to the position of the plunger.

To this end, the subject of the disclosure is a multi-control hydraulic circuit of the type defined above, characterized in that the pressure compensator has a fluid link equipped with a choke and connecting the outlet to the control line, irrespective of the position of the plunger.

By virtue of this fluid link, the pressure compensator gives the multi-control hydraulic circuit a certain operational flexibility since the control pressure is not limited to the maximum pressure imposed on the control line by the receiver having the highest load.

Pressure at a progressive level, not fixed at a constant value, builds up thanks to the exchange of fluid between the circuits of the receivers by means of the pressure compensators.

According to another advantageous feature, the fluid link traverses the plunger, connecting a side of the plunger which is always opposite the outlet of the compensator and the top of the plunger which opens out into the control line.

This design of the fluid link as a permanent link in the general sense forms a solution which is technically very interesting because it is simple to implement.

According to another feature, the compensator has a lateral passage which starts at the inlet and the outlet of which opens out laterally into the outlet with a variable cross-section which depends on the equilibrium position of the plunger as a function of the output which comes from the distributor, a separation zone which closes the outlet for the lateral passage in the depressed position of the plunger when the outlet pressure of the distributor is less than the control pressure, the fluid link opening into the outlet beyond the separation zone so as to remain open when the plunger is in the depressed position.

According to another advantageous feature, the fluid link consists of a transverse passage which opens out into the outlet beyond the separation zone which separates the transverse passage from the opening of the lateral passage and from a longitudinal passage opening into the top of the plunger.

According to the disclosure, the choke of the fluid link is preferably formed in the longitudinal passage, which simplifies its production, in preference to a choke formed in the transverse passage; indeed, the latter opens out on both sides of the plunger so as to guarantee communication with the outlet of the compensator.

According to another advantageous feature, the fluid link is formed by a transverse passage which opens out into the outlet beyond the separation zone between the opening of the lateral passage and of a longitudinal passage which opens out into an upper transverse passage which is open laterally beneath the top, a choke connecting the upper transverse passage to the top of the plunger, opening out into the line.

This alternative embodiment has the advantage of modifying the choke cross-section connecting the plunger piston of the dominant circuit to the linking duct with respect to the passage cross-section of the chokes in the other fluid links through which hydraulic fluid from the control line escapes to the plunger pistons and the circuits of the other receivers.

Generally, the permanent fluid link between the control duct and the outlet of the compensator makes it possible to make the operation flexible, which is extremely advantageous for controlling the circuit.

BRIEF DESCRIPTION OF THE DRAWINGS

The present disclosure will be described below in more detail with the aid of examples of the multi-control hydraulic circuit shown in the attached drawings, in which.

In the description of the drawings, the words "lower" and "upper" correspond to the orientation of the drawings.

DETAILED DESCRIPTION

Figure 1:
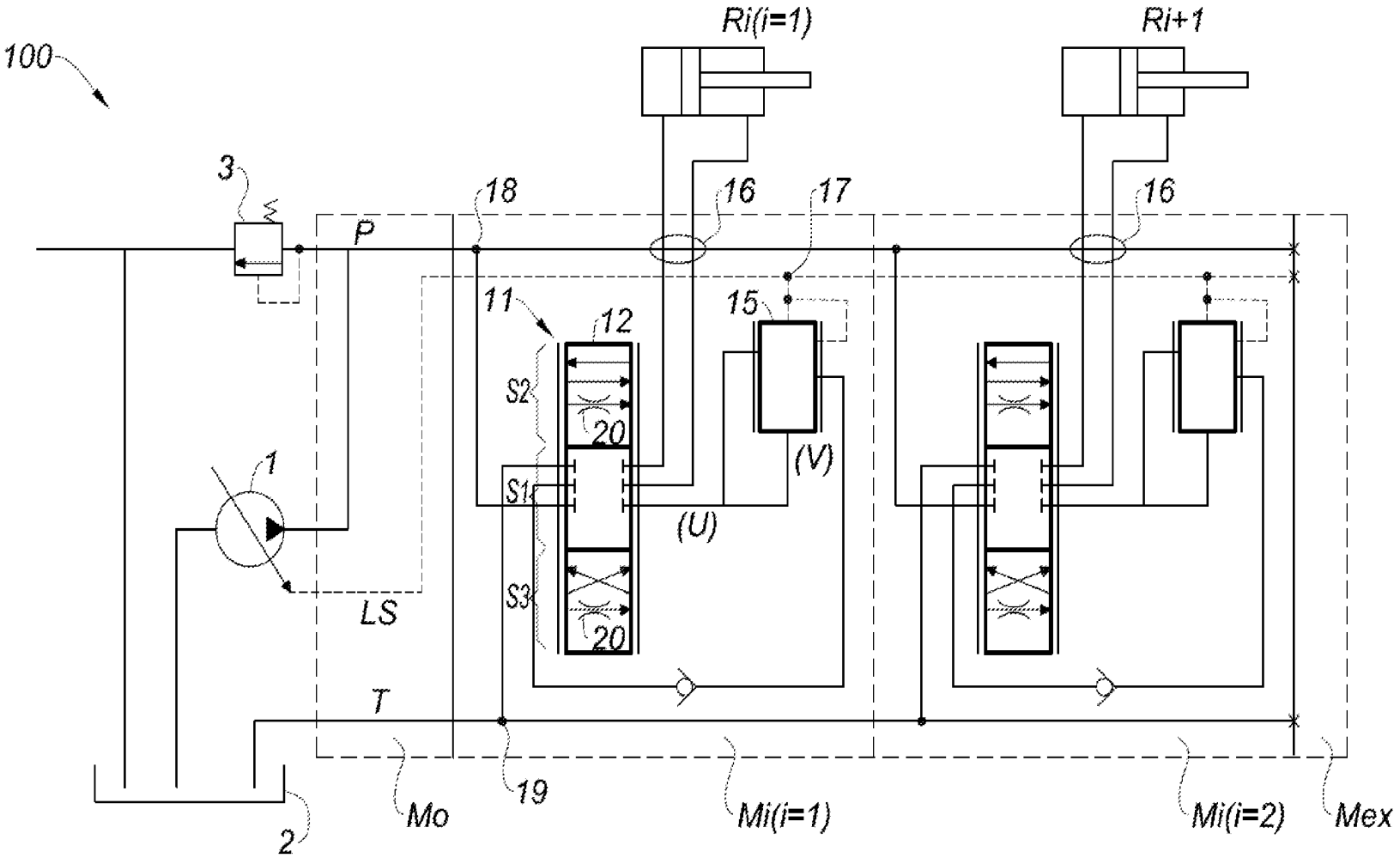
FIG. 1 is a diagram of a multi-control hydraulic circuit with two modules.

FIG. 1 shows a multi-control hydraulic circuit 100 which supplies receivers R1, Ri (i=1-2 . . . ) with hydraulic fluid at a regulated pressure, delivered by an adjustable pump 1 which draws fluid from a tank 2.

The receivers Ri, the number of which depends on the equipment controlled by the hydraulic circuit 100, are, for example, dual-action actuators, single-action actuators but also rotary actuators or motors. At the outlet of the receivers, the hydraulic fluid returns to the tank 2 via the circuit.

The multi-control hydraulic circuit 100 consists of modules Mi (i=1, 2 . . . ) each associated with a receiver Ri and connected in parallel to the duct P for supplying hydraulic fluid at a regulated pressure Pr and to the return duct T to the tank 2. The supply duct P has a pressure limiter 3 which limits the pressure to a maximum level $P_m$; its outlet is connected to the tank 2.

The pump 1 is controlled by the control pressure line LS connected to the modules Mi and transmitting the control pressure Pc delivered by the modules as a function of the load pressure of the receivers Ri.

The ducts (also referred to as lines P, LS, T) are formed by bores traversing the modules Mi in the form of stacked plates. The stack of modules Mi is equipped with an inlet Mo for the branch to the pump 1 and to the tank 2, and with an end module Mex which closes the ducts.

The modules Mi have the same general structure and their description will thus be limited to one module Mi and its receiver Ri (i=1 . . . ).

Each module Mi has a distributor 11, the slide valve 12 of which is activated by the operator according to the maneuver to be performed with the receiver Ri which it controls. It adjusts the output of fluid to be delivered to the receiver Ri supplied as a function simply of the maneuvering of the slide valve 12 (its choke 20) by means of the pressure compensator 15 combined with the distributor 11. The pressure compensator 15, the general operation of which is known, will be explained below.

Each module Mi thus has an active outlet 16, an inlet 17 (outlet) for the control pressure Pc (line PS), an inlet 18 for pressurized hydraulic fluid (line P), and an outlet 19 (line T) leading to the tank 2.

The outward/return branches for the hydraulic fluid of the receiver Ri are conventionally considered as an active outlet since only the "outward" direction is important and since the two ducts are reversed depending on the controlled direction of the receiver Ri.

The hydraulic fluid supply inlet 18 is connected via the distributor 11 by the line U to the inlet of the pressure compensator 15, the outlet V of which supplies the receiver Ri, returning via the distributor 11 which then performs the role of a switch for supplying either chamber of the receiver Ri if the latter is a dual-action type; in the case of a single-action receiver, only the hydraulic chamber will be supplied directly and the distributor will not have this switching function. The switching function is performed by the slide valve 12.

In the conventional representation used here, the slide valve 12 has an intermediate segment S1 for the neutral position, blocking the inlet and outlet of the receiver Ri. This segment S1 is bordered on each side by a segment S2, S3 with a passage (choke 20) with a cross-section which can vary according to the position of the slide valve 12 so as to connect either directly the chambers A and B of the receiver (supply and return to the tank) or by reversing this supply to the chambers A and B. The reversing segment S3 is not provided for a single-action receiver.

The hydraulic circuit of the module Mi is in LUDV mode, with the compensator 15 downstream of the choke 20 of the distributor 11, as opposed to LS mode in which the pressure compensator 15 would be installed upstream of the choke 20. However, in both cases, the pressure control line is conventionally referred to as the "pressure control line LS".

Figure 1A:
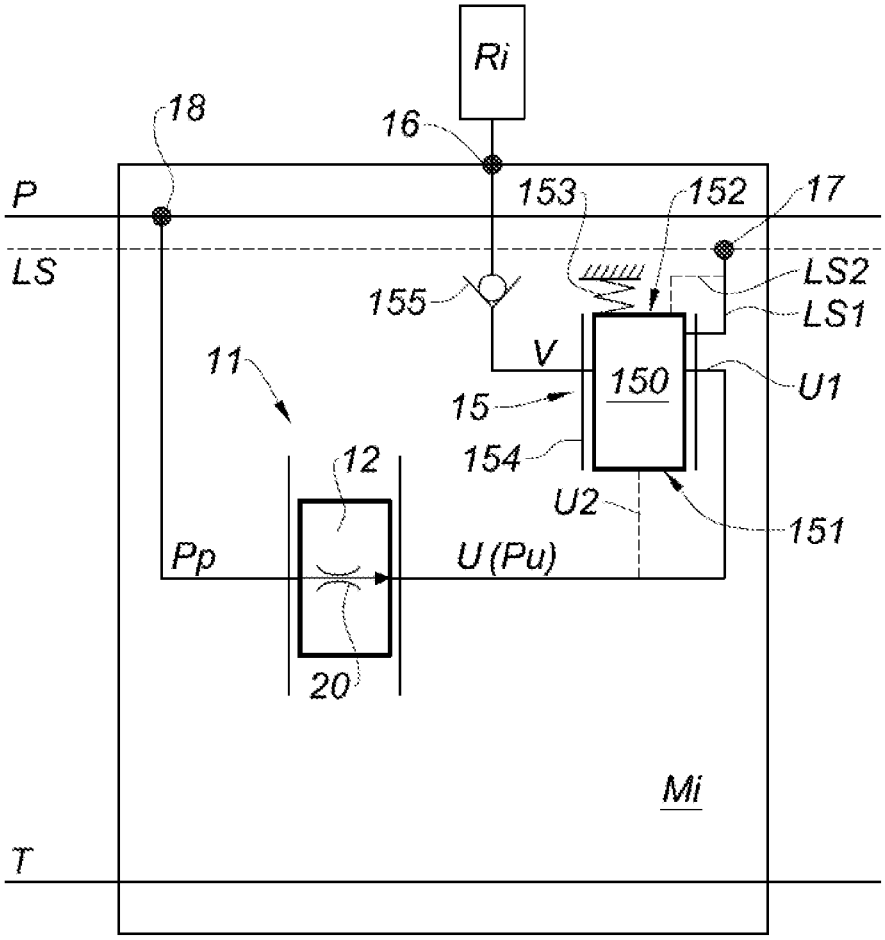
FIG. 1A is an enlarged schematic detail of an example of a module of the circuit in FIG. 1, FIGS. 2A-2C are schematic views in cross-section of a known pressure compensator shown in three positions, the shut-down position (FIG. 2A), the equilibrium position (FIG. 2B) and the end-of-travel position (FIG. 2C)

FIG. 1A shows, in a simplified fashion, a single module Mi on an enlarged scale. In this module Mi, only the active lines, those for fluid circulation and those for pressure transmission, have been shown of the ducts between the lines P, LS, T and the distributor 11 as well as the compensator 15. Thus, all that is shown in the drawing of the distributor 11 is the variable cross-section (choke 20) of the slide valve 12 which is connected downstream by the line U to the inlet U1 of the compensator 15, and by the link U2 to its face 151 for transmitting pressure. The line V is the link connected at the outlet of the compensator 15 to the receiver Ri. The line LS is connected by the branch LS2 to the face 152 of the plunger 150 so as to transmit its pressure Pc thereto, and to the inlet LS1 for the passage of hydraulic fluid. The face 152 can be additionally subject to the action of a set spring 153.

The pressure Pu of the line U acting on the face 151 of the plunger 150 exerts a thrust, which tends to open the passage between the lines U and V, which is opposite to that exerted on the face 152 which acts in a direction which closes the said passage.

The simplified drawing thus shows the direct link from the outlet of the compensator 15 to the active outlet 16 without passing through the distributor 11 which is completely transparent, the link via the distributor being necessary only in order to reverse the supply to the chambers of the receiver.

The return of fluid from the receiver Ri has been omitted since this is unpressurized fluid returning to the tank 2, for example directly.

Figure 3A:
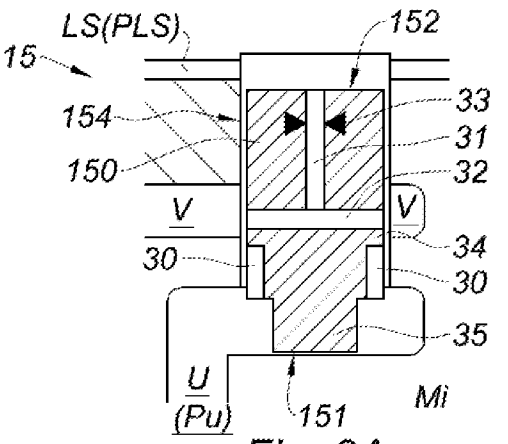
FIGS. 3A-3C show a first embodiment of a pressure compensator according to the disclosure, in the three characteristic positions, the shut-down position (FIG. 3A), the equilibrium position (FIG. 3B) and the end-of-travel position (FIG. 3C)
Figure 3B:
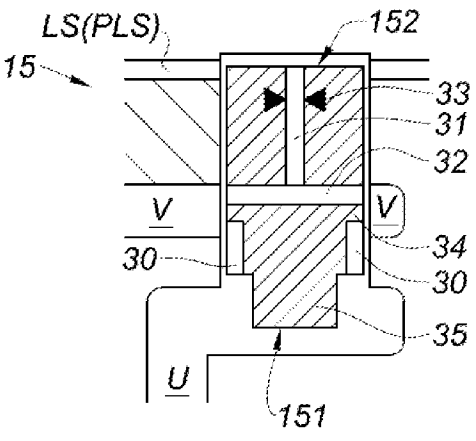
Figure 3C:
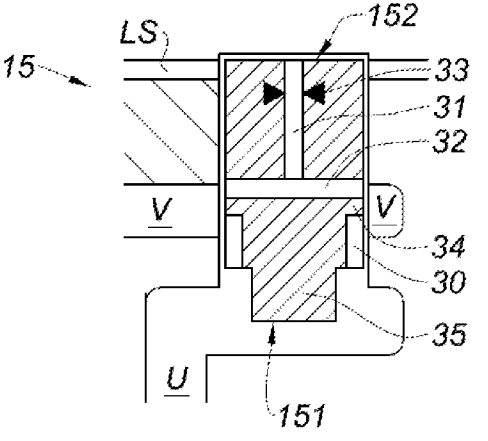

In this simplified diagram, the plunger 150 of the compensator 15 is the plunger of a compensator of the disclosure, shown respectively in three positions in FIGS. 3A-3C; 4A-4C.

The module Mi is representative of the modules (Mi=1-2 . . . n) of the multi-control hydraulic circuit 100 (FIG. 1) controlling the receivers Ri (i=1-2 . . . n). The receivers Ri necessarily have different loads (pressures) and, according to the known operation, the module Mj, the receiver Rj of which has the highest load at a given moment, applies this load as the control pressure $P_{LS}$ to the pump 1 which, depending on this pressure, supplies the different modules Mi.

In this organization, the control pressure $P_{LS}$ imposed by the module Mj translates, at the level of the other modules Mi (which are active, i.e. their distributor actively controls the receiver associated with this module), into an identical pressure difference at the ends of each distributor 11 such that the distributors distribute the output delivered by the pump 1 to the line P as a function solely of the passage cross-section (choke 20) regulated by the slide valve 12 of the distributor 11 of each module Mi. This distribution is not fixed because in a multi-control hydraulic circuit 100 the operation of the modules Mi can vary since some modules will be shut down and others will be activated; each time, the dominant module with the receiver with the greatest load imposes its pressure in order to control the pump 1, the output of which will then be distributed under the same conditions as above as a function of the new surface of the passage cross-section of each slide valve 12 of the activated module.

The changes in state of the various modules Mi cause variations in pressure which translate into operation with sudden variations in each module Mi, which the disclosure overcomes by smoothing the operation of the multi-control hydraulic circuit 100 by making the rigid link according to the prior art between the load of the dominant module and the other modules more flexible.

To clarify this situation, a pressure compensator will be presented below in a general manner (FIGS. 2A-2C) in comparison with pressure compensators according to the disclosure (FIGS. 3A-3C; 4A-4C).

Figure 2C:
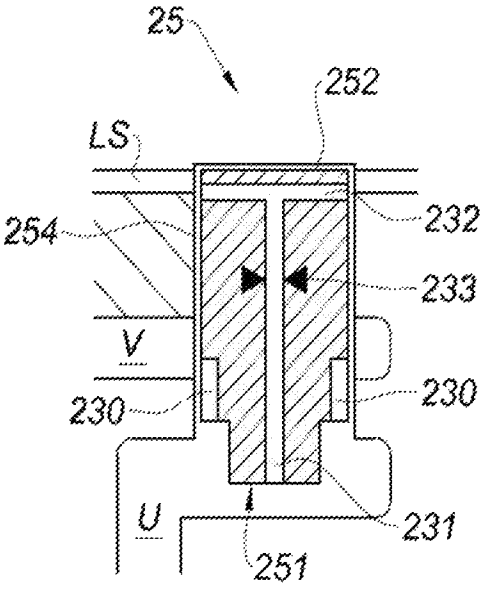
Fig. 2C Prior Art
Figure 2B:
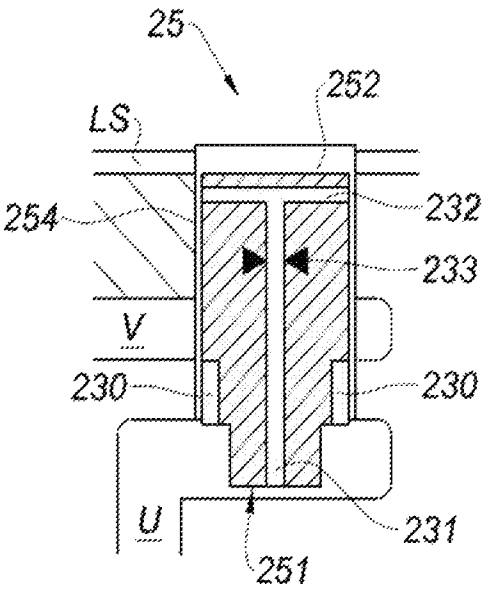
Fig. 2B Prior Art
Figure 2A:
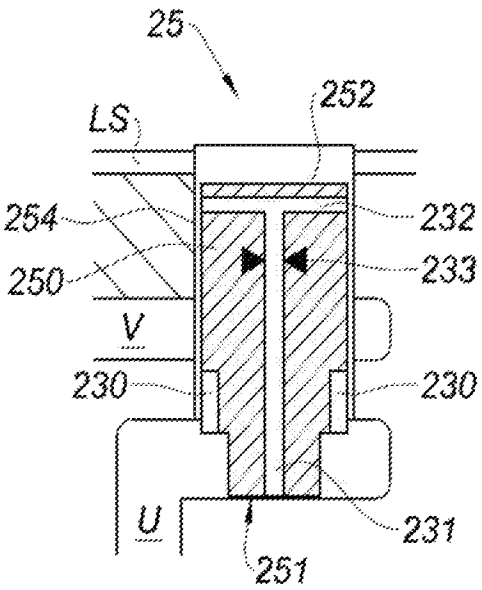
Fig. 2A Prior Art

FIGS. 2A-2C thus show a module Mi with a known pressure compensator 25 in its initial position (FIG. 2A), in its equilibrium position (FIG. 2B) and in its end-of-travel position (FIG. 2C).

The compensator 25 has a bore 254 accommodating the plunger 250. The line LS traverses the top of the bore 254; the outlet duct V issues from the side of the bore 254 and the inlet duct U opens out into the lower part of the bore 254. The duct U is connected to the outlet of the passage 20 of the slide valve 12 of the distributor 11. The duct V is the outlet duct of the compensator 25 and is connected to the active outlet 16 of the module Mi and to the receiver Ri.

The plunger 250 has a lateral passage 230 (or a set of passages distributed over the periphery), a longitudinal passage 231 equipped with a choke 233 and opening out into a transverse duct 232 in the upper part of the plunger below the upper face 252 of the plunger 250.

The lateral passage 230 connects, with a surface with a variable cross-section, the ducts U and V as a function of the position of the plunger 250 in the bore 254.

The known compensator 25, operating in LUDV mode, will be described below.

Initially, at start-up (FIG. 2A) the plunger 250 is in a lowered position; there is no pressure, neither in the control line LS nor in the pump line P and the duct U, the pump being shut down.

The starting-up of the pump 1 causes an output at pressure $\Delta P_0$ at the outlet; this pressure is transmitted by at least one compensator 25 (assuming that the distributor of the circuit is activated) and hence into the control line LS with a control pressure $P_{LS}$ which will be $P_{LS}=\Delta P_0$ and arrives at the face 252 of the plunger 250; gradually, the control pressure of the pump 1 increases and finally reaches the pressure required by the distributor.

During normal operation (FIG. 2B), the compensator 25 is at equilibrium, which means that the two faces 251, 252 are at the same pressure (it being assumed that the active surfaces of the faces are equal). The outlet of the distributor 11 is thus at the pressure $P_{LS}$ imposed by the plunger 250 transmitting to its lower face 251 the pressure $P_{LS}$ applied to its upper face 252 and its inlet is at the outlet pressure Pp of the pump 1.

Now the pump 1, controlled at the pressure $P_{LS}$ outputs at pressure $Pp=P_{LS}+\Delta P_0$; $\Delta P_0$ is the difference in pressure that the pump adds to the control pressure to achieve the pressure Pp at the outlet.

The distributor 11 is thus subject to a constant pressure difference $\Delta P_1-\Delta P_0$ such that its output $Q_1$ depends only on the (variable) opening cross-section 20 controlled by the operator manipulating the distributor 11.

The communication between the inlet U and the outlet V of the compensator 25 is exposed to a difference in pressure $\Delta P_0=P_V-P_U$ ($=P_{LS}$), which gives $\Delta P_2=\Delta P_0$. This difference in pressure is constant.

The passage cross-section between U and V in the compensator 25 when at equilibrium is thus adjusted automatically since the output Q1 is imposed on it by the distributor 11.

If the compensator 25 has a set spring acting as a complement to the pressure $P_{LS}$, the situation is slightly modified but the above described operating principle remains the same.

The operation assumes that the outlet pressure $P_V$ is not less than the load pressure; otherwise, the non-return valve 155 is unable to open to supply the receiver Ri. This state of affairs is equivalent to when the hydraulic system starts operating, when the control pressure $P_{LS}=0$ and when the pump 1 begins to output at pressure $\Delta P_0$ and then the control pressure $P_{LS}$ gradually reaches the highest load pressure of the activated receivers.

If the thrust generated by the pressure Pu and applied to the face 251 exceeds that exerted on the other face 252, the plunger 250 reaches the end of its travel, completely opening the inlet of the duct V and connecting the duct U to the line LS, transmitting to it the pressure Pu reduced by the choke 233 (FIG. 2C).

The plunger 250 imposes its pressure as a control pressure in the line LS controlling the pump 1 and then operates as a selector for the pressure of the module Mi with the highest loaded receiver Ri. In the other active modules Mi, the compensators operate as pressure-regulating valves. The situation varies according to which of the modules Mi supplies the highest load at any given moment.

This distribution of the output, which is advantageous per se, nevertheless has disadvantages in terms of operational inflexibility when a module is shut down or when another module is activated, as has been described above.

The pressure compensator 15, 15*a* according to the disclosure makes it possible to reduce or overcome this difficulty.

FIGS. 3A-3C show a first embodiment of a pressure compensator 15 according to the disclosure, installed in the bore 154 of the module Mi, with its ducts LS, U, V. The set spring 153 has not been shown.

FIGS. 3A-3C thus show the module Mi with a pressure compensator 15 in its initial position (FIG. 2A), in its equilibrium position (FIG. 2B) and in its end-of-travel position (FIG. 2C).

The compensator 15 has a bore 154 accommodating the plunger 150. The line LS traverses the top of the bore 154; the outlet duct V issues from the side of the bore 154 and the inlet duct U opens out into the lower part of the bore 154. The duct U is connected to the outlet of the passage 20 of the slide valve 12 of the distributor 11. The duct V is the outlet duct of the compensator 15 and is connected to the active outlet 16 of the module Mi and to the receiver Ri.

According to the convention of the diagram in FIG. 1, the plunger 150 has a lateral passage 30 (or a set of passages distributed over the periphery), a longitudinal passage 31 equipped with a choke 33 and opening out on the upper face 152 of the plunger 150, a linking passage 32 connected to the longitudinal passage 31 and opening out into the outlet duct V, irrespective of the rotational position of the plunger in the bore 154 and irrespective of its longitudinal position.

The lateral passage 30 connects, with a surface with a variable cross-section, the ducts U and V as a function of the position of the plunger 150 in the bore 154.

According to a combination of FIGS. 3A, 3B and FIG. 1A, the fluid passage duct U1 is formed by the lateral passage 30; the pressure duct U2 is the opening out of the duct U below the plunger 150. The fluid duct LS1 is the connection via the longitudinal passage 31 and the linking passage 32; the pressure duct LS2 is the opening out of the line LS in the bore 134.

The longitudinal passage 31 with a choke 33 opens out, on the one hand, in the top part 152 and, on the other hand, in a linking passage 32 which traverses the lower part of the plunger 150, above its lateral passage 30 but without connecting therewith. There is a separation zone 34 between the opening of the linking passage 32 and the lateral passage or passages 30. The lower part 35 of the plunger 150 forms an abutment when the plunger 150 is depressed.

Thrust on the (upper) face 152 of the plunger 150 tends to close the U/V connection between the inlet duct U and the outlet duct V, and an opposite thrust, generated by the pressure Pu exerted on the other (lower) face 151 tends to open the U/V connection.

In normal mode (FIG. 3B), the plunger 150 assumes an equilibrium position according to the pressure $P_{LS}$ applied to the face 152 and transmitted to its face 151 so as to arrive at the distributor 11, the output Q1 of which will be adjusted by the choke 20.

In all the positions of the plunger 150, including the end-of-travel position in FIG. 3C, the line LS connects with the duct V via the longitudinal passage 31 with its choke 33 and the transverse passage 32 such that if the pressure $P_{LS}$ in the line LS is greater than the pressure in the duct, fluid will pass from the line LS to the ducts V, U. Only in the extreme position of there being no pressure in the duct U is the plunger 150 depressed so much that the separation zone cuts the in connection between the ducts U and V and leaves only the link between the line LS and the duct V.

However, according to an alternative embodiment, there is no separation zone 34.

In all the variable equilibrium positions of the plunger 150, there is a floating connection between the ducts U and V, with a positive or negative draining to or from the line LS via the passage 31 and the linking passage 32.

In an alternative embodiment described and shown, the permanent connection between the ducts V and LS can be effected in the body of the compensator 15 and not in the plunger 150. This solution is advantageous but that of the plunger 150 equipped with this connection (31-32) has the advantage of greater flexibility and ease of manufacture because, according to demand, it is possible to equip a same module with a plunger with or without the communication 31-32.

In the compensators 15 according to the disclosure, the line LS which connects the different modules Mi effects an exchange of fluid through the "draining" paths in the plungers 150 such that the pressure $P_{LS}$ of the line LS controlling the operation of the pump 1 will be less than the pressure imposed by the module associated with the regulator Ri with the highest load pressure.

This "fuzzy" control pressure $P_{LS}$ is less than the maximum control pressure which would be imposed in an installation operating in LUDV mode and, according to the disclosure, enables much more flexible operation of the hydraulic installation, in particular when the different modules Mi are shutting down/starting up.

In this example of a compensator 15 according to the disclosure, the lower face 151 is overall and substantially the visible upper surface of the plunger 150; the situation is similar for the upper face 152. The effective hydraulic surfaces of these faces 151, 152 are reduced in a variable fashion by virtue of the connection between the ducts 31, 32, 33.

Figure 4A:
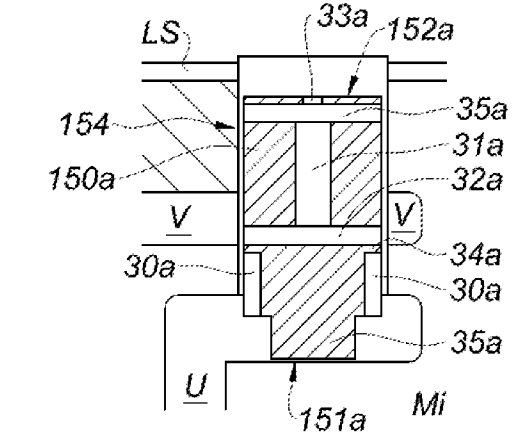
FIGS. 4A-4C show a second embodiment of a pressure compensator according to the disclosure, in the three characteristic positions, the shut-down position (FIG. 4A), the equilibrium position (FIG. 4B) and the end-of-travel position (FIG. 4C)
Figure 4B:
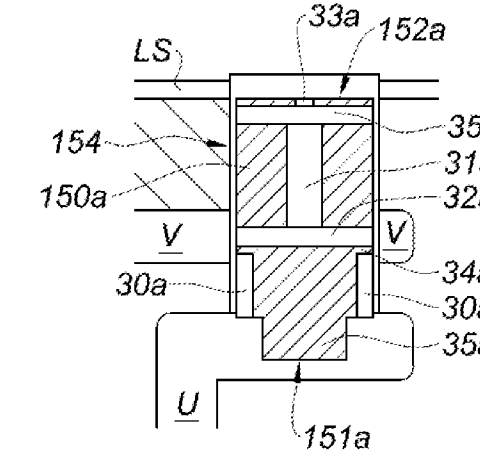
Figure 4C:
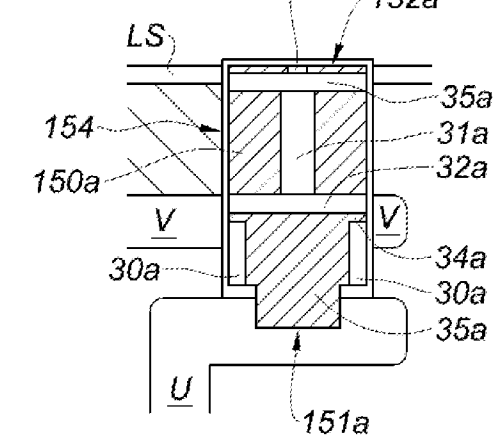

FIGS. 4A-4C show an alternative embodiment of the pressure compensator 15*a* according to the disclosure. This alternative differs from the embodiment in FIGS. 3A-3C in the top 152*a* of the plunger 150*a*.

The plunger 150*a* has a longitudinal passage 31*a* with no choke, opening out in the bottom part into the transverse passage 32*a* like the plunger 150, with a separation zone 34*a* and, below the latter, a lateral passage 30*a*.

In the upper part, the longitudinal passage 31*a* arrives in an upper transverse passage 35*a* which opens out on the sides and is connected to the face 152*a* of the top of the plunger 150 via a choke 33*a*.

The operation of the pressure compensator 15*a* is overall the same as that of the plunger 15, as long as the upper transverse passage 35*a* is covered by the bore 154 because, at this moment, the choke 33*a* of the plunger 150*a* is the equivalent of the choke 33 of the plunger 150. Only when the top of the plunger 150*a* opens out into the line LS does the choke 33*a* not take effect since the connection is freed up through the plunger 150. This means that at this moment, the same pressure prevails in the line LS and in the ducts V and U. Thus the module Mj associated with the receiver Rj having the greatest load will impose this load on the line LS, rather than a pressure reduced by the reduction in pressure generated by the choke 33*a*.

The difference between the cross-section S1 of the choke 33*a* and that S2 of the transverse passage 35*a* accentuates the fuzziness.

In the upper position of the plunger 150*a* associated with the receiver Ri having the greatest load, the connection between the duct U and the line LS is effected in a direction issuing through the transverse passage 35*a*, whereas it is assumed that the compensators of the other active modules Mi will be at equilibrium. This means that the transverse passage 35*a* of these plungers 150*a* will be interrupted and the connection between the line LS and the line V or U will be effected by the choke 33*a*.

Figure 5:
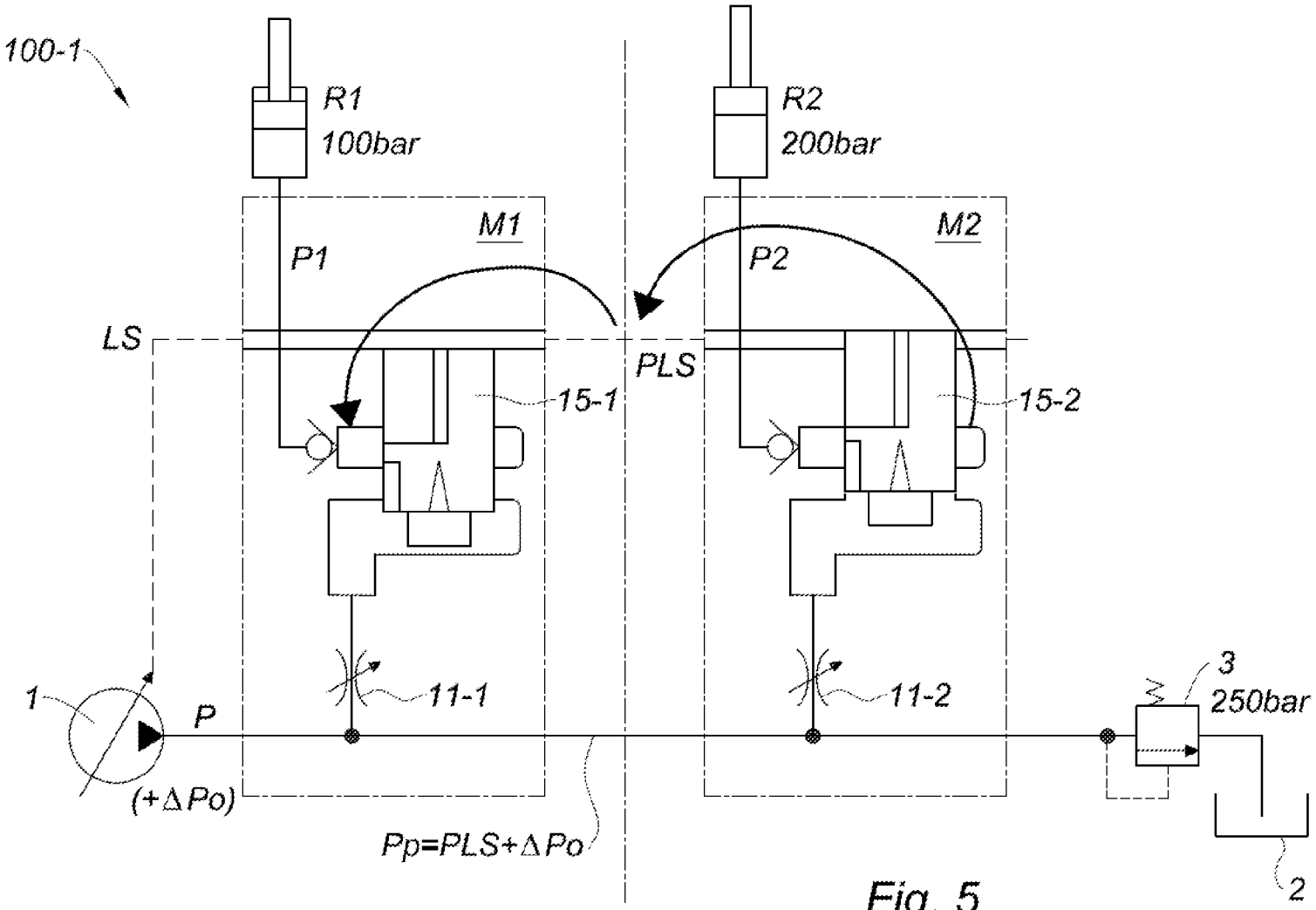
FIG. 5 shows, in a highly schematic form, an example of a multi-control hydraulic circuit consisting of two modules.

FIG. 5 shows an example of a multi-control circuit 100-1 with a plurality of modules Mi, two modules M1, M2 of which are shown.

They correspond to the structure in FIG. 1 and the receivers R1, R2 respectively have a pressure of 100 bar and 200 bar as a load. The pressure limiter 3 has a threshold which is fixed at 250 bar.

It is assumed that the receiver R2 is shut down, its piston being at the end of its travel. The module M2 therefore transmits the inlet pressure $P=P_{LS}+\Delta P_0$ delivered by the pump 1 to the line LS through the compensator 15-2 with a pressure drop $\Delta P2$.

If hypothetically, such as before the receiver R2 is shut down, the pressure is 200 bar, it can be assumed that the pump pressure $Pp(=P_{LS}+\Delta P_0)$ is greater than the load pressure $P_1$ of the receiver $R_1$.

Since the receiver R1 is active, its compensator 15-1 is at equilibrium and transmits the control pressure $P_{LS}$ which is thus applied at the outlet of the distributor 11-1.

The distributors which have a load pressure greater than the pump pressure will shut down and the distribution of the output of the pump will be more fuzzy because of the average pressure reduction.

| LIST OF MAIN ELEMENTS (not including letter suffixes) | |
|---|---|
| 100 | multi-control hydraulic circuit |
| 11 | distributor |
| 12 | slide valve |
| | S1 } segments of the slide valve |
| | S2 } segments of the slide valve |
| | S3 |
| 15 | pressure compensator |
| | 150 plunger |
| | 151 first face/bottom |
| | 152 second face/top |
| | 153 set spring |
| | 154 bore |
| | 155 non-return valve |
| 30 | lateral passage |
| 31 | longitudinal passage |
| 32 | transverse passage |
| 33 | choke |
| 34 | separation zone |
| 35 | upper transverse passage |
| 25 | pressure compensator |
| | 250 plunger |
| | 251 first face/bottom |
| | 252 second face/top |
| | 254 bore |
| 230 | lateral passage |
| 231 | transverse passage |
| 232 | longitudinal passage |
| 233 | choke |
| 16 | active pressure outlet |
| 17 | control pressure inlet |
| 18 | hydraulic fluid inlet |
| 19 | outlet to the tank |
| 20 | variable choke of the slide valve |
| 1 | supply pump |
| 2 | tank |
| 3 | pressure limiter |
| Mi | distributor module |
| Ri | receiver |
| P | pump line |
| T | return line to the tank |
| LS | control pressure line |
| $P_{LS}$ | control pressure |
| $P_P$ | pump pressure |
| U | inlet of the compensator |
| V | outlet of the compensator |

What is claimed is:

1. A multi-control hydraulic circuit for supplying receivers with hydraulic fluid delivered by a pump with an output controlled by a control pressure of a control line depending on a load pressure of the receivers and delivering the hydraulic fluid at a regulated pressure, the hydraulic circuit comprising:

a plurality of hydraulic modules each associated with one of the receivers, each hydraulic module comprising:

a slide valve configured for activation by an operator, the slide valve further configured to regulate a variable output supplying the receiver via a variable choke, the slide valve having a slide valve outlet downstream of the variable choke that has a slide valve outlet pressure; and a pressure compensator comprising a compensator inlet connected to the slide valve outlet, a compensator outlet connected to a supply of the receiver by a non-return valve, and a plunger configured to manage a connection between the compensator inlet and the compensator outlet, wherein the plunger comprises:

a first face exposed to the slide valve outlet pressure; and a second face exposed to the control pressure of the control line, wherein, in an equilibrium state of the plunger, the slide valve outlet pressure and the control pressure are equal such that the slide valve of each hydraulic module is subjected to a fixed pressure difference corresponding to a difference between the control pressure and a pump pressure of the pump, wherein the plunger defines a lateral passage connecting the compensator inlet and the compensator outlet according to a position of the plunger, and wherein the pressure compensator further includes a fluid link having a choke through which the compensator outlet is permanently connected to the control line, irrespective of the position of the plunger.

2. The hydraulic circuit according to claim 1, wherein:

the fluid link traverses the plunger and connects a side region at a side of the plunger and the second face of the plunger, the side region is always connected to the compensator outlet, and the second face adjoins the control line.

3. The hydraulic circuit according to claim 2, wherein:

the lateral passage starts at the compensator inlet and defines a lateral passage outlet configured to open out laterally into the compensator outlet with a variable cross-section which depends on an equilibrium position of the plunger as a function of the slide valve outlet pressure;

a separation zone which closes the lateral passage outlet in a depressed position of the plunger when the slide valve outlet pressure is less than the control pressure, wherein the side region, where the fluid link opens into the compensator outlet, is on an opposite side of the separation zone from the lateral passage so se that the fluid link remains open when the plunger is in the depressed position.

4. The hydraulic circuit according to claim 3, wherein the fluid link is formed by (i) a transverse passage which opens out into the compensator outlet on the side region on the opposite side of the separation zone from the lateral passage such that the transverse passage is separated from the lateral passage opening and (ii) a longitudinal passage that opens from the second face.

5. The hydraulic circuit according to claim 4, wherein the choke of the fluid link is formed in the longitudinal passage.

6. The hydraulic circuit according to claim 3, wherein:

the fluid link is formed by:

a first transverse passage which opens out into the compensator outlet of the pressure compensator on an opposite side of the separation zone from the lateral passage, a second transverse passage which is open laterally beneath the second face of the plunger, and a longitudinal passage connecting the first and second transverse passages, wherein the choke of the fluid link connects the second transverse passage to the second face, opening out into the control line.

* * * * *